US005450051A

United States Patent [19]

Stromberg

[11] Patent Number: 5,450,051

[45] Date of Patent: Sep. 12, 1995

[54] ELECTRONIC TRANSIT FARE CARD SYSTEM

[76] Inventor: Ronald E. Stromberg, 2058 W. 42nd Street, Vancouver, B.C., Canada, V6M 2B3

[21] Appl. No.: 291,103

[22] Filed: Aug. 16, 1994

[51] Int. Cl.[6] ..... G07B 15/02

[52] U.S. Cl. ..... 235/384; 235/375; 235/380

[58] Field of Search ..... 235/375, 380, 384

[56] References Cited

U.S. PATENT DOCUMENTS

| | | | |
|---|---|---|---|
| 3,483,361 | 12/1969 | Blurton . | |
| 3,501,622 | 3/1970 | Weir et al. . | |
| 3,859,507 | 1/1975 | Konya | 235/384 |
| 4,288,688 | 9/1981 | Kiyama et al. . | |
| 4,488,035 | 12/1984 | Withnall et al. . | |
| 4,717,815 | 1/1988 | Tomer . | |
| 4,720,785 | 1/1988 | Shapiro . | |
| 4,861,971 | 8/1989 | Chan . | |
| 4,977,502 | 12/1990 | Baker et al. . | |
| 4,984,170 | 1/1991 | Hirahara . | |
| 5,054,092 | 10/1991 | LaCaze . | |
| 5,225,665 | 7/1993 | Zerfahs et al. . | |
| 5,241,162 | 8/1993 | Ilie et al. . | |

FOREIGN PATENT DOCUMENTS 2020715 5/1994 Canada .

*Primary Examiner*—Harold Pitts
*Attorney, Agent, or Firm*—Woodard, Emhardt, Naughton, Moriarity & McNett

[57] ABSTRACT

A card system and method for accessing a public transit system that employs a card pre-encoded with trip data permitting a set number of trips on the transit system and a card processing unit to receive and process a card each time access to the transit system is desired. The card processing unit includes a time write head to record the time of current use on the card and a time read head to retrieve the time of last use from the card. A microprocessor computes the difference between the time of current use and the time of last use. A trip read head scans the encoded trip data to determine the number of trips remaining on the card and a trip write head is provided to write to the card to decrement the number of trips by a given amount after use. The trip write head and the time write head are employed only if the difference between the time of current use and the time of last use is greater than a preset period. The card system automatically handles access to the transit system and transfers from one transit vehicle to another within the transit system thereby permitting faster vehicle loading, reduced fare evasion and increased driver concentration on vehicle operation.

18 Claims, 4 Drawing Sheets

ELECTRONIC TRANSIT FAR CARD SYSTEM

FIELD OF THE INVENTION

This invention relates to an electronic card system for accessing public transit that automatically accommodates transfers between different transporting vehicles in the transit system.

BACKGROUND OF THE INVENTION

A public transit system to transport people, particularly to and from work, is generally considered a requirement in most larger communities. Public transit permits movement of large volumes of passengers and can significantly reduce pollution levels by reducing levels of car use. It is desirable that a public transit system be as efficient and cost-effective as possible. Currently, most existing public transit systems have evolved into systems that use time dated paper receipts issued by a bus driver or dispensing machine in order to travel on the system. The paper receipt enables passengers to move or transfer free of charge from one vehicle to another as part of a single transit trip, however, the system requires that vehicle operators constantly check for correct fare payment, issue receipts and inspect paper receipts of transferring passengers. With the operator responsible for all these duties on top of operating the vehicle, it is not surprising that fare evasion is easy and can reach substantial levels.

Attempts have been made to automate the process of paying for a ride on a transit system to improve efficiency and lower fare evasion. Applicant is aware of the following patents that are directed to devices and systems useful in automating access to a public transit system:

U.S. Pat. No. 4,977,502 to Baker discloses a transit vehicle fare box for issuing and accepting magnetically encoded fare cards and processing fares according to stored fare tables.

U.S. Pat. No. 4,488,035 to Withnal et al. discloses a ticketing system for use in a passenger transport system. The device uses a ticket reader capable of optically reading information printed on a ticket in bar code. The tickets can be scanned by a reader on a bus that can distinguish between valid and invalid tickets.

U.S. Pat. No. 4,984,170 to Hirahara discloses an automatic ticket vending machine that monitors the day and time at which a ticket is issued to accommodate variations in the ticket price based on the day or time that the ticket is to be used.

U.S. Pat. No. 3,483,361 to Blurton discloses an automatic fare collection system that checks for fare payment on a route having multiple zone fares. The system relies on the bus driver activating a switch when the bus passes into a new fare zone.

U.S. Pat. No. 3,501,622 to Weir et al. discloses an automatic fare system which uses a ticket having magnetic code information and human readable coordinate information as to the initial ticket value and decreasing ticket value as the card is used. The system relies on the trip fare being deducted from the card on exiting from the transit system.

U.S. Pat. No. 5,225,665 to Zerfahs et al. shows a ticket processing device for transit vehicles capable of issuing tickets of different value according to the distance to be travelled. Information is stored on a magnetic strip on the ticket, and, if a multiple ride ticket is purchased, the system is capable of reducing the value of the ticket for each ride taken.

In the foregoing systems, the problem remains that paper receipts must still be issued and vehicle operators must continue to check receipts in order to handle transfer of passengers within the transit system. Otherwise, each time a passenger enters a vehicle, they must pay a fare which is clearly unacceptable to a passenger who must transfer between a number of transit routes in a single trip to reach a destination or who must transfer from a bus to a rail rapid transit line.

SUMMARY OF THE INVENTION

The present invention provides an apparatus and method that overcomes the transfer problem of prior art systems. The present invention provides a card system for accessing public transit that is also able to handle automatically transfers.

Accordingly, in a first embodiment, the present invention provides a card system for accessing a public transit system comprising:

- a card pre-encoded with trip data permitting a set number of trips on the transit system;
- a card processing unit to receive and process a card each time access to the transit system is desired, the card processing unit including:
- means to write to the card the time of current use;
- means to read from the card the time of last use;
- logic means to compute the difference between the time of current use and the time of last use;
- means to read the encoded trip data to determine the number of trips remaining on the card; and
- means to modify the trip data of the card to decrement the number of trips by a given amount;
- whereby the means to modify the trip data and the means to write to the card the time of current use are employed only if the difference between the time of current use and the time of last use is greater than a preset period.

In a further aspect, the present invention provides a method for accessing a public transit system comprising the steps of:

- providing a card encoded with data permitting a set number of trips on the transit system;
- inserting the card into a card processing unit each time access to the transit system is desired, the card processing unit acting on first insertion of the card to:
- write the current time to the card;
- decrement the number of trips encoded on the card by a given amount; and
- for each subsequent insertion of the card, read the time of last use, compute the difference between the time of last use and the current time, and decrement the number of trips by a given amount and write the current time to the card only if the difference in time is greater than a set period.

By automating the transfer function, the present invention allows faster vehicle loading, reduces fare evasion and permits increased operator concentration on vehicle operation.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
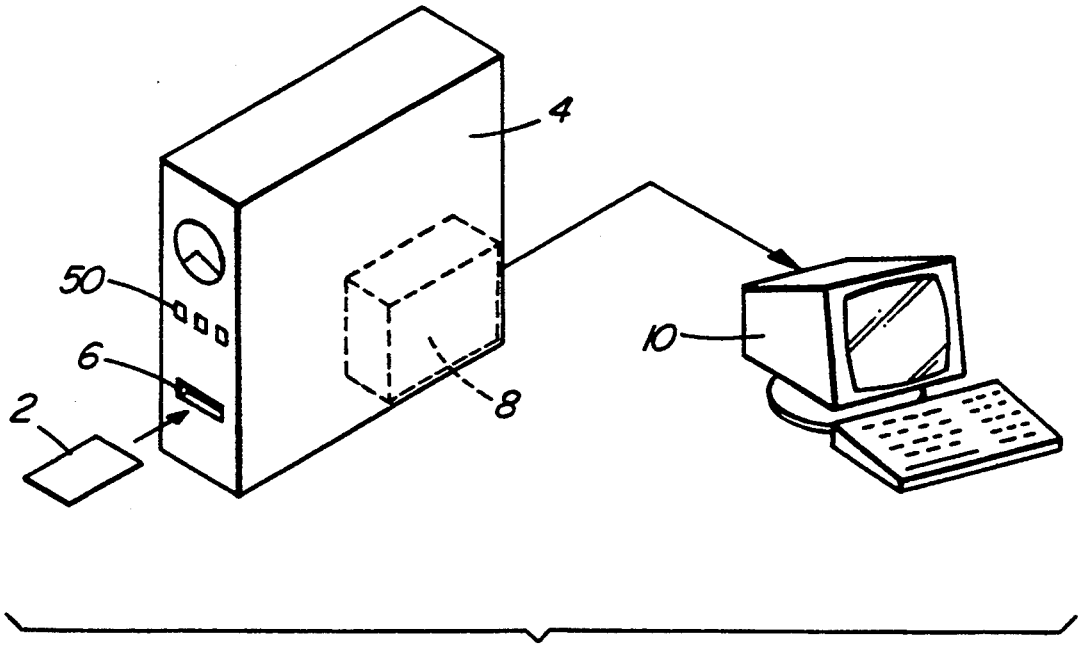
FIG. 1 is a schematic view of the system of the present invention showing the card, the card processing unit, and computer equipment for downloading and analyzing information collected by the system.

Referring to FIG. 1, there are shown the various components of the card system of the present invention useful for accessing a public transit system. The system employs a card 2 that is pre-encoded with trip data permitting a set number of trips on the transit system. Card 2 is intended to replace existing fare media such as tickets, tokens, monthly passes or cash paid on board transit vehicles. It is intended that card 2 will be available at retail outlets and transit ticket dispensing machines encoded with a set number of trips. For example, cards can be provided in 10 or 20 ride values or a premium two ride card would be sold on buses to serve occasional riders.

Card 2 is insertable into a card processing unit 4 each time access to the transit system is desired by a rider. Separate card processing units 4 are provided on each transit surface vehicle, such as buses or street cars, and in rapid transit stations to open turnstiles for system access or exit to rapid transit systems.

Card processing unit 4 is provided with a slot 6 for insertion of card 2. When the card is inserted, the card processing unit 4 is activated to scan the card, write the time of system access by the card user to the card in a form that can be read back at a later time and complete the transaction by decrementing the number of trips on the card. The operation of the card processing unit is controlled and co-ordinated by a microprocessor 8 with associated data storage means. The microprocessor can be programmed to decrement one or more rides from the card for each use. For example, it is common that travel during peak periods such as rush hours costs more, and the card processing unit can be programmed to decrement a card by two rides for each access to the transit system during rush hour.

By writing the time of system access to card 2 in a form readable by processing unit 4, card 2 becomes a transfer from one vehicle to another or from one part of the transit system to another in order to complete a transit trip. It is usual practice for such transfers between vehicles of the transit system to be free if they occur within a limited period. When a transfer from one vehicle to another is desired, the user inserts the card into the card processing unit in the usual manner to re-gain access to the transit system. Card processing unit 4 scans the card and reads the time of last use. The processing unit compares the time of last use with the current time and if the difference between the two times is greater than a preset transfer period, the processing unit writes the new time of use to the card and decrements the card by another ride. If the difference between the two times is less than the preset period, the processing unit returns the card to the user without writing the time of current use or decrementing a ride from the card while still permitting access to the transit system. In this manner, the preset period for a valid transfer continues to run from the time of original entry to the transit system until the transfer period expires.

The data storage means of the card processing unit can be used to store data regarding each card transaction. This data can be downloaded to a computer 10 running software for analyzing the data. The data provides valuable information to the operators of the transit system, such as hourly rider demand by route and at intersecting transit routes along the way. This information, particularly at peak periods, is vital to determine the size of the transit fleet to handle maximum ridership. The data automatically collected by the system of the present invention allows the transit operators to monitor how often and where transfers occur within a transit network.

The foregoing description provides a general overview of the card system according to the present invention. Embodiments of the present invention are shown in FIGS. 2–8 which illustrate the card and the card handling and processing elements of the card processing unit 4.

Figure 7:
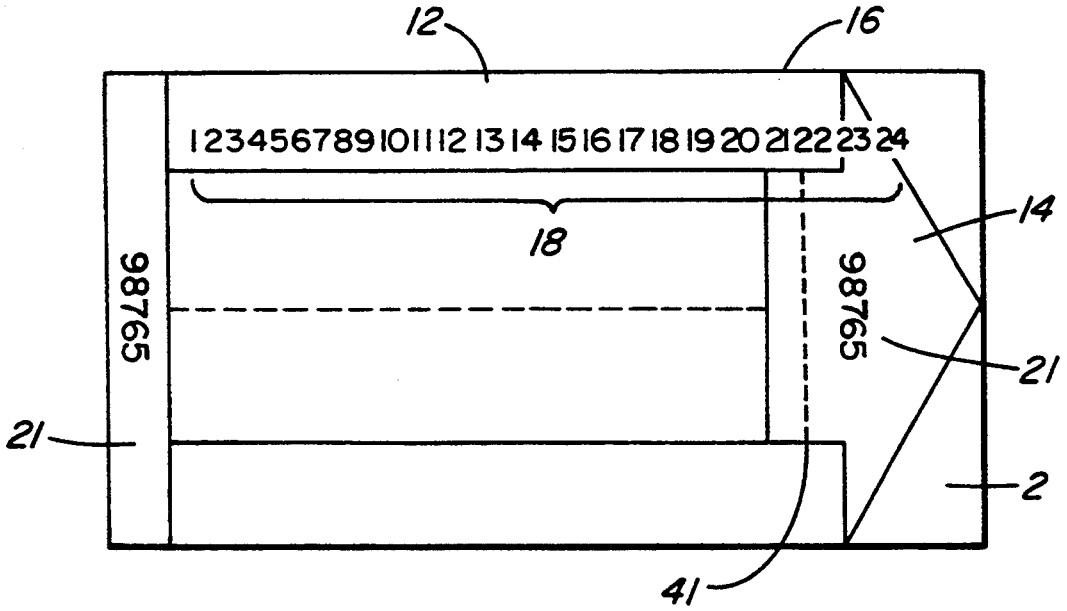
FIG. 7 is a front view of a card for use in the system of the present invention.
Figure 8:
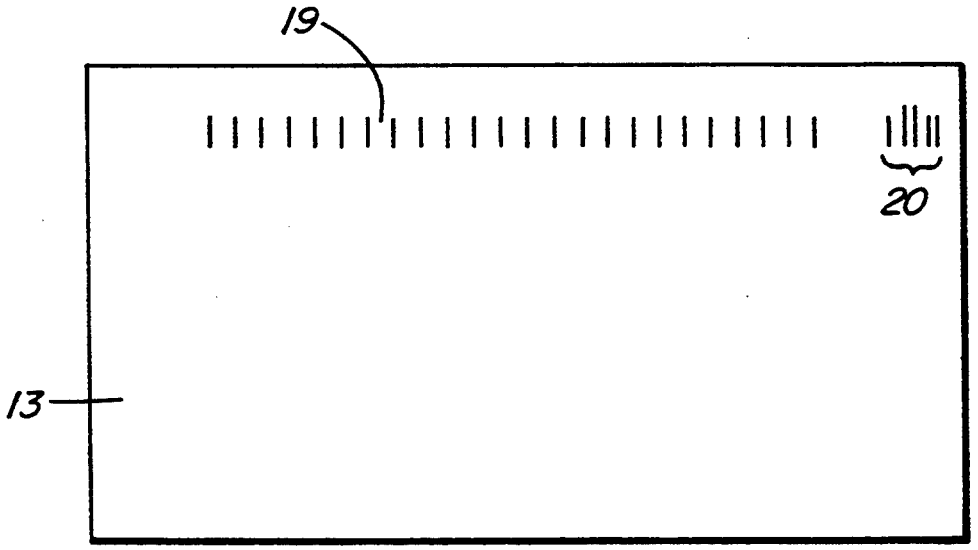
FIG. 8 is a rear view of a card for use in the present system.

FIGS. 7 and 8 illustrate the two sides of a card intended for use in the present system. Preferably, the card is credit card size and is constructed of material such as rigid, thin cardboard to handle normal day to day use. It is desirable to mark the front face 12 of the card with a large arrow 14 to indicate the correct orientation for insertion into slot 6 of card processing unit 4. Along an edge 16 of the card are marked a series of numerals 18 that indicate to the card user the number of rides that the card will provide. Cards with different numbers of rides can be made available for purchase and users can buy cards appropriate to their particular needs.

FIG. 8 provides a view of the back face 13 of the card. Face 13 is marked by a series of short strips or patches 19 that are marked on the card using magnetic ink. Magnetic ink is ink that contains ferrous particles that can be easily magnetized. Each magnetic ink patch 19 corresponds to a numeral 18. Also marked on the card with magnetic ink is a set of coded strips 20 that are used by the transit company to verify the validity of the card each time it is inserted into the card processing unit.

At each end of the card, matching numbers 21 can be marked to allow the card to be used as a lottery ticket. This will tend to keep cards from being discarded and littering the streets when all trips are used up. The user would tear the card in half and deposit one half in a box provided by the transit company and retain the second half. The collected ticket stubs would be eligible for drawing in a lottery run by the transit company for a certain period, for example, a year. After the given period, the collected ticket stubs would be recycled and replaced by a supply of new card stubs. This foregoing arrangement provides a useful marketing tool for the transit company to promote sales of the cards. Furthermore, numbers 21 can be used to control distribution and track losses or theft of cards.

Figure 4:
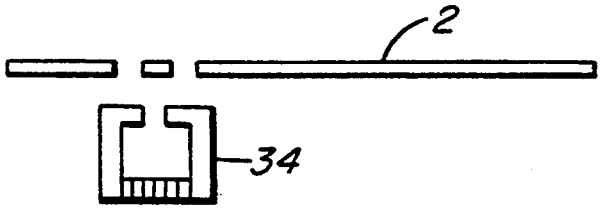
FIG. 4 is a schematic view of the reading mechanism for scanning the pre-encoded trip data on the card.
Figure 2:
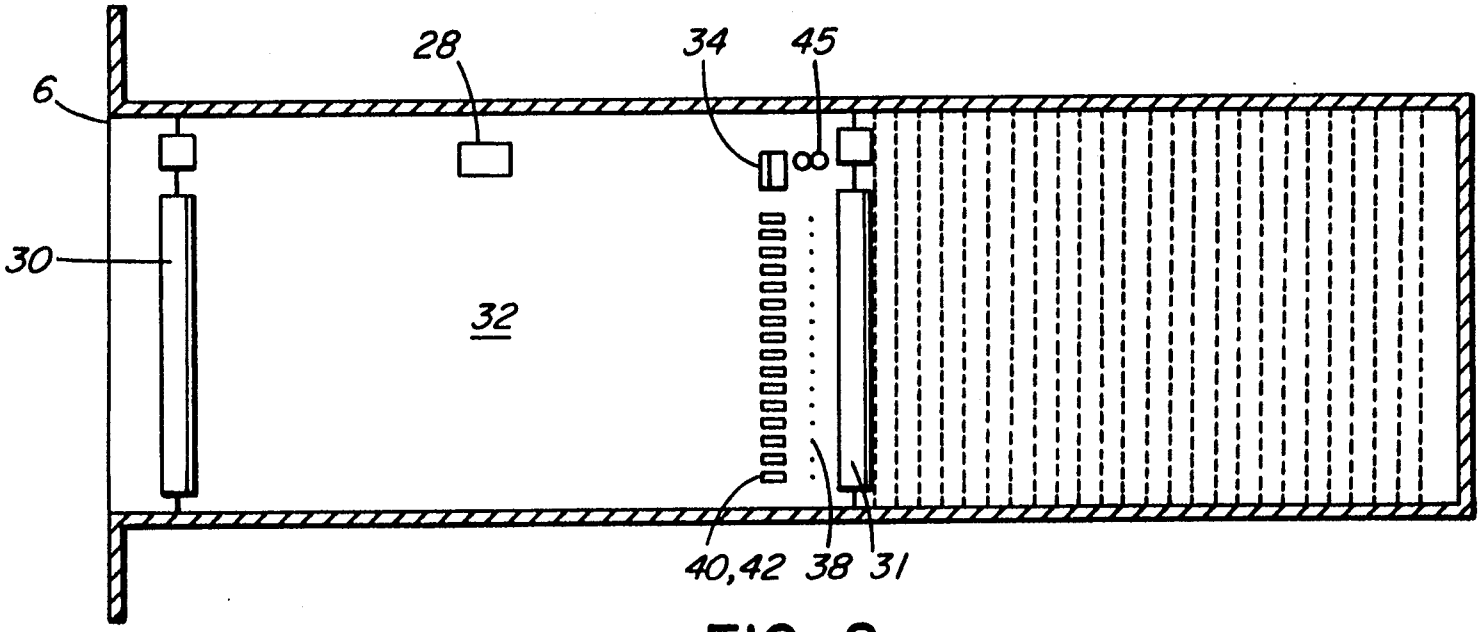
FIG. 2 is a schematic plan view of the equipment in the card processing unit for handling the card.
Figure 3:
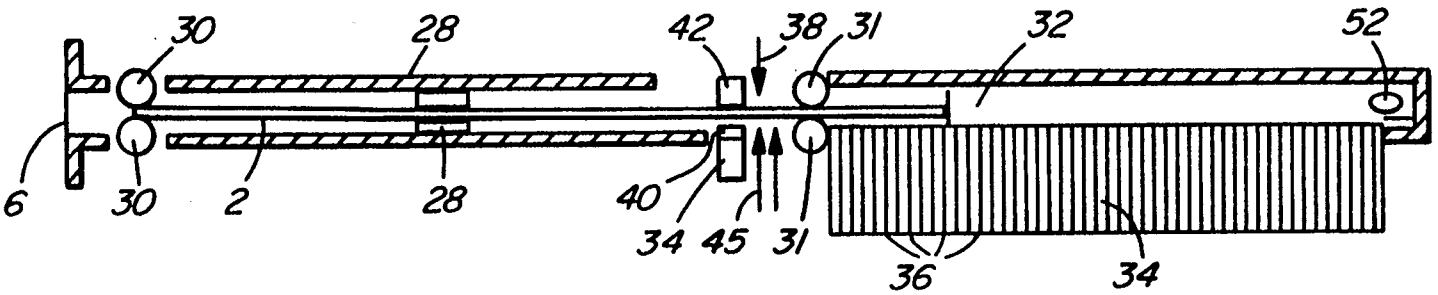
FIG. 3 is a schematic elevation of the card handling equipment of FIG. 2.

FIGS. 2 and 3 show schematically a first embodiment of the means within slot 6 for manipulating an inserted card. FIG. 3 includes a card in place within the slot. Initially, there are a pair of rollers 30 that engage the card and feed it into the interior 32 of slot 6 where a second set of rollers 31 assist in guiding movement of the card. As card 2 is moved within slot 6, magnetic ink patches 19 are moved between means to magnetize the patches comprising a pair of like pole magnets 28. This ensures that the magnetic ink patches 19 are strongly magnetized each time a card is inserted. The card then moves past means to read the patches comprising a magnetic read head 34. FIG. 4 is a schematic diagram of a suitable magnetic read head 34, for example a Brush TM read head.

As shown in FIGS. 2 and 3, a support surface 34 is positioned beyond rollers 31 that includes variable stop means comprising a series of individual plates 36 that are raisable into the path of card 2 to stop movement of the card. When head 34 detects an unperforated magnetic patch 19 indicating the next available trip, the card is stopped and examined for transfer code information as will be explained below. If further processing of the card is necessary, head 34 sends a signal to the controlling microprocessor 8 that activates an appropriate plate 36 to stop the card such that the card is positioned for processing with respect to the other equipment of the card processing unit. Rollers 31 then advance the card to the plate 36.

Alternatively, the rollers 30 and 31 can be used alone to manipulate an inserted card. Rollers 30 engage and feed the card at a constant velocity, for example 20 inches per second. Rollers 30 feed the card to second rollers 31 which are variable speed rollers that position the card for reading and writing. When head 34 detects an unperforated magnetic ink patch 19, the card is stopped and examined for transfer code information. If further processing is necessary, head 34 sends a signal to the controlling microprocessor 8 to activate rollers 31 to advance the card such that the card is positioned for processing with respect to the other equipment of the card processing unit. In this alternative design, stop plates 36 are unnecessary as rollers 31 are responsible for proper positioning of the card.

Figure 5:
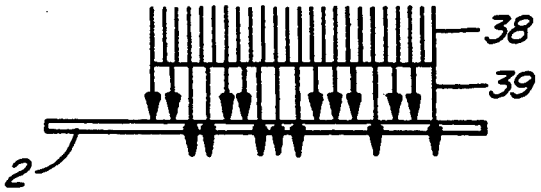
FIG. 5 is a schematic view of the writing mechanism to mark the time of current use on the card.

There is provided means to write to the card the time of current use comprising a multiple sharp point perforation or punch unit 38. Punch unit 38 is positioned to perforate a series of pin-holes through card 2. Microprocessor 8 obtains the current time from a real time clock and activates the appropriate pins 39 of punch unit 38 to punch a pattern of holes that code for the current date and time of day. FIG. 5 shows the holes being punched. The pattern of holes are, in effect, a transfer code that allow the card of the present invention to be used to take multiple trips on different vehicles of the transit system provided that the trips occur within a certain period. FIG. 7 shows a pattern of holes 41 in card 2 that form a transfer code. The pattern of holes that form a transfer code are preferably generated and recognized by a specialized microchip. The microchip generates a pseudo-random pattern of holes to represent a particular time to ensure that fraudulent modification of the transfer code is not possible. In reality, punch unit 38 is updated with the time every fifteen minutes rather than being continuously updated.

Figure 6:
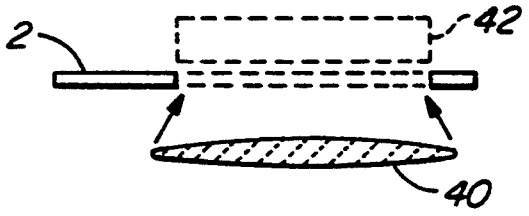
FIG. 6 is a schematic view of the reading mechanism for detecting the time of last use of the card.

Referring to FIGS. 2, 3 and 6, there is also provided means to read from the card the time of last use comprising a light source 40 positioned on one side of the card and an optical sensor unit 42 positioned on the opposite side of the card. Light shining through the transfer code perforations in the card is detected by the optic sensor unit 42. Unit 42 sends a signal to microprocessor 8 that is decoded to provide the time of last use of the card.

Referring to FIGS. 2 and 3 once again, there is also provided means to modify the trip data of the card comprising punch unit 45. Punch unit 45 is positioned with respect to card 2 in order to perforate the card with one or more holes at the magnetic ink patch 19 representing the current trip. By punching perforations in the card through a particular magnetic ink patch 19, the signal detected by read head 34, when that particular patch is scanned, is modified. Thus, the microprocessor 8 can distinguish between a patch with holes representing a used trip or a patch without holes representing an unused trip. In effect, by perforating a magnetic ink patch 19, punch unit 45 is decrementing the number of trips available on the card and also allowing read head 34 to position the card the next time the card is inserted by scanning for the next available unperforated magnetic ink patch 19. In addition, since the magnetic ink patches 19 are aligned with trip numerals 18 on the opposite side of the card, the perforations through the numerals provide a clear indication on the face of the card to the user of the remaining number of trips available on the card.

Note that two punch units 45 are provided so that during peak hours two rides can be decremented at a time from the card effectively raising the cost of a trip during peak periods.

The overall operation of the card processing unit is as follows with reference to FIG. 2:

Each time a card is inserted into slot 6, rollers 30 and 31 advance the card until an unperforated magnetic ink patch 19 is detected by read head 34 at which point the card is stopped. When the card is stopped, light source 40 and optical sensor unit 42 that co-operate as a transfer code reader are positioned to read the last transfer time. Microprocessor 8 compares the time of last transfer use to the current time obtained from the real time clock. If the difference between the time of current use and the time of last use is greater than a preset period (transfer period) stored in memory, the microprocessor will activate rollers 31 to advance the card such that the unperforated ink patch 19 is positioned below the punch unit 45. Punch unit 45 is then activated to decrement one or more rides. Microprocessor 8 also activates punch unit 38 to write the time of current use to the card. The card is then ejected from slot 6. All relevant transaction data is stored in the memory of the card processing unit and is available for further analysis.

If the difference between the time of current use and the time of last use is less than the transfer period, the card processing unit will signal that the card provides access to the vehicle, but the processing unit will not decrement a trip from the card or write the time of last use to the card since the card is acting in its role as a transfer. The card will be ejected from the slot and the transfer period will continue to run from the time of the last ride that was paid for.

If card 2 has no valid trips left on it (indicated by there being no unperforated ink patches 19 on the card), the card will be fed by rollers 30 and 31 all the way into the interior of slot 32 until the card engages sensor 52. Sensor 52 signals microprocessor 8 to reverse rollers 30 and 31 and return the card to the user.

Card processing unit 4 is provided with a user interface to indicate to the user the status of any card transaction. For example, there are a series of status lights 50 on the front panel of the card processing unit 4 labelled "PAID", "TRANSFER" and "VOID" that indicate respectively whether the card has been decremented by a trip, whether a transfer has been recorded or some error has occurred such as the card having no valid trips. An audible signal is also provided to signal the user with a distinctive tone depending on the status of the transaction.

Figure 9:
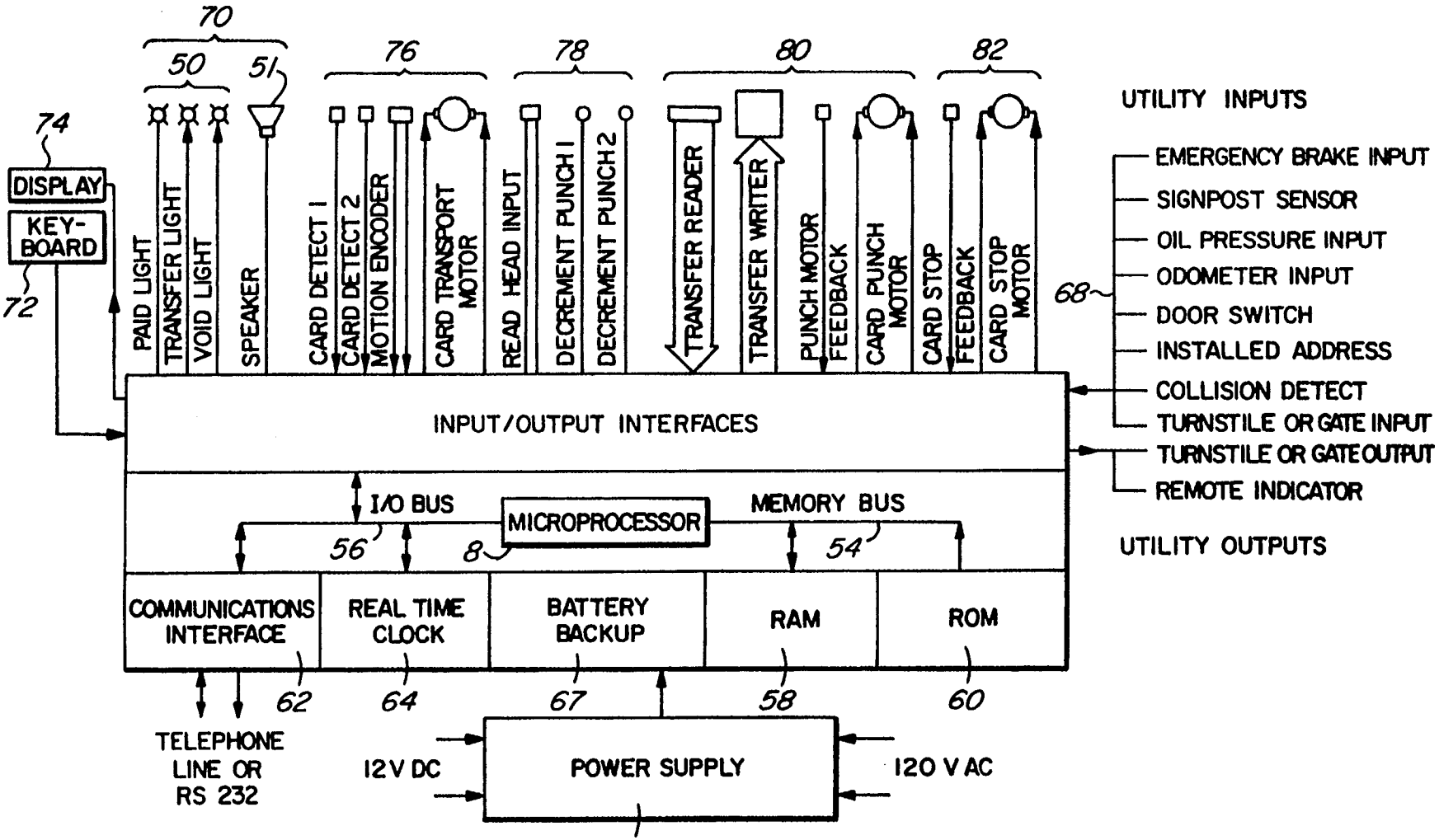
FIG. 9 is a schematic diagram showing the interconnection and control of the various components of the card processing unit of the present invention.

FIG. 9 shows a schematic diagram of the interconnection between the various components of the card processing unit. Microprocessor 8 interfaces with memory and input/output devices through appropriate buses 54 and 56, respectively.

Random access memory (RAM) 58 is provided to store data regarding card transactions. While the card is not necessarily written to each time it is inserted in the card processing unit, data regarding each card transaction is stored in RAM 58. This data can include such information as the time of each card insertion, whether the card trip data was modified or a transfer occurred, the elapsed time for a card transaction and the location of the transaction in the transit system.

Read-only memory (ROM) 60 is provided to store programing instructions for microprocessor 8.

There is a communications interface 62 to allow collected data to be downloaded to a computer running software to analyze the data. Communication interface 62 can be designed to transit data over a telephone line or through a standard RS-232 serial connector.

There is a real time clock 64 that supplies the time to microprocessor 8.

A power supply 66 is used to provide the power to the card processing unit. A battery backup 67 ensures a continuous supply of power in case of a power failure. Power supply 66 is preferably able to be sourced by either the 12 volt DC power of a vehicle battery or normal 120 volt AC power.

When card processing unit 4 is installed in a transit vehicle means to monitor the distance travelled by the vehicle is necessary to track the location of the vehicle in the transit system. A sensor 68 provides information regarding the distance travelled by interfacing with the odometer pickup.

A user interface 70 is provided to track the status of a card transaction, as previously discussed, using indicator lights 50 and audible alarm 51. In addition, a keyboard 72 and display 74 are used to enter programming information into the unit.

Each of the various components for handling and processing of a card are also interfaced to the microprocessor bus 56. Movement of the card 2 by rollers 30 and 31 is controlled at 76. The operation of punch unit 45 to decrement trips is controlled at 78. The reading and writing of transfer codes to and from the card is controlled at 80 and positioning of the card by stop surfaces 36 is controlled at 82.

Although the present invention has been described in some detail by way of example for purposes of clarity and understanding, it will be apparent that certain changes and modifications may be practised within the scope of the appended claims.

I claim:

1. A card system for accessing a public transit system comprising:

a card pre-encoded with trip data permitting a set number of trips on the transit system;

a card processing unit to receive and process a card each time access to the transit system is desired, the card processing unit including:

means to track the time;

means to write to the card the time of current use of the card in the card processing unit;

means to read from the card the time of last use;

logic means to compute the difference between the time of current use and the time of last use;

means to read the encoded trip data to determine the number of trips remaining on the card; and means to modify the trip data of the card to decrement the number of trips by a given amount;

whereby the means to modify the trip data and the means to write to the card the time of current use are employed only if the difference between the time of current use and the time of last use is greater than a preset period.

2. A system as claimed in claim 1 in which the card processing unit includes data storage means to store data each time a card is inserted into the card processing unit, the data being stored including time of the card insertion, whether the card trip data was modified, and the location in the transit system.

3. A system as claimed in claim 2 in which the card processing unit is mounted in a vehicle of the transit system and the processing unit includes means to monitor the odometer of the vehicle to track the location of the vehicle on the routes of the transit system.

4. A system as claimed in claim 1 in which the card processing unit is positioned at a fixed location within the transit system.

5. A system as claimed in claim 2 including means for downloading the stored transaction data to a computer for analysis.

6. A system as claimed in claim 1 in which the trip data is encoded on each card by a plurality of magnetic patches, each patch permitting a trip on the transit system.

7. A system as claimed in claim 6 in which the magnetic patches are formed using magnetic ink.

8. A system as claimed in claim 6 in which the means to read the encoded trip data of the card comprises a magnetic read head capable of detecting a first signal from the magnetic patch and the means to modify the trip data comprises a punch unit for perforating the card across a magnetic patch to modify the signal detected by the read head.

9. A system as claimed in claim 8 including means for magnetizing the magnetic patches prior to the magnetic read head.

10. A system as claimed in claim 9 in which the means for magnetizing the magnetic patches comprises a pair of like pole magnets positioned on either side of the card.

11. A system as claimed in claim 8 in which the card is initially marked to indicate the total number of trips available on the card, and the punch unit acts to modify the card appearance after each use to clearly indicate on the card face the remaining number of trips available on the card.

12. A system as claimed in claim 1 in which the means to write to the card the current time comprises a punch unit for perforating the card with a pattern of perforations that represent the current time.

13. A system as claimed in claim 12 in which the means to read from the card the time of the last use comprises:

a light source positionable with respect to the card on one side of the card; and an optic sensor unit positionable with respect to the card on the other side of the card to detect any light transmitted through perforations in the card, the pattern of light being interpreted to reveal the time of last use.

14. A system as claimed in claim 12 in which the pattern of perforations is pseudo-random, the pattern being generated and decodable by a microchip.

15. A system as claimed in claim 1 in which the card processing unit includes a slot into which a card is inserted and means for automatically manipulating an inserted card to process the card.

16. A system as claimed in claim 14 in which the means for automatically manipulating the card comprises:

a support surface for the card;

rollers for moving the card over the support surface;

variable stop means to align and hold the card in the card processing unit whereby the rollers move the card over the support surface for scanning by the means for reading the encoded trip data until data for the next trip is detected whereupon the stop means is activated to stop the card within the card processing unit such that the card is positioned for processing with respect to the means to write the time of current use, the means to read the time of last use, and the means to modify the trip data.

17. A method for accessing a public transit system comprising the steps of:

providing a card encoded with data permitting a set number of trips on the transit system;

inserting the card into a card processing unit each time access to the transit system is desired, the card processing unit acting on first insertion of the card to:

write the current time to the card;

decrement the number of trips encoded on the card by a given amount; and for each subsequent insertion of the card, read the time of last use, compute the difference between the time of last use and the current time, and decrement the number of trips by a given amount and write the current time to the card only if the difference in time is greater than a set period.

18. A method as claimed in claim 17 including the additional step of storing information in card processing unit memory storage each time a card is used regarding the time of use, whether the trip data was decremented, and the location of use in the transit system.

* * * * *